US010352585B1

(12) United States Patent
Brown

(10) Patent No.: US 10,352,585 B1
(45) Date of Patent: Jul. 16, 2019

(54) MULTI-PASS BOILER AND RETROFIT METHOD FOR AN EXISTING SINGLE-PASS BOILER

(71) Applicant: Theodore S. Brown, Newport, ME (US)

(72) Inventor: Theodore S. Brown, Newport, ME (US)

( * ) Notice: Subject to any disclaimer, the term of this patent is extended or adjusted under 35 U.S.C. 154(b) by 0 days.

(21) Appl. No.: 15/892,826

(22) Filed: Feb. 9, 2018

(51) Int. Cl.
*F24H 1/32* (2006.01)
*F24H 9/00* (2006.01)
*F24H 1/26* (2006.01)

(52) U.S. Cl.
CPC ..... *F24H 9/0031* (2013.01); *F24H 1/263* (2013.01); *F24H 1/32* (2013.01); *F24H 9/0015* (2013.01); *F24H 9/0026* (2013.01)

(58) Field of Classification Search
CPC . F24H 1/30; F24H 1/32; F24H 9/0015; F24H 9/0026; F24H 9/146
See application file for complete search history.

(56) References Cited

U.S. PATENT DOCUMENTS 1,524,520 A 1/1925 Junkers
2,548,287 A 4/1951 Blake, Jr.
3,618,572 A * 11/1971 Nauert ..... F24H 1/32 122/225 R
3,805,745 A * 4/1974 Block ..... F22B 15/00 122/367.3
4,026,246 A 5/1977 Colle et al.
4,158,345 A 6/1979 Trestin
4,282,833 A 8/1981 Giesen
4,291,649 A 9/1981 Boeder
4,292,933 A 10/1981 Meier et al.
4,346,901 A 8/1982 Booth
4,356,794 A 11/1982 Bouman et al.
4,401,101 A 8/1983 Lunde
4,421,066 A 12/1983 Gordbegli
(Continued)

OTHER PUBLICATIONS

"MPC High Efficiency Cast Iron Multi-Pass Commercial Water Boiler" Burnham Commercial Boilers; Lancaster, PA; no date.
(Continued)

*Primary Examiner* — Gregory A Wilson
(74) *Attorney, Agent, or Firm* — W. F. Fasse

(57) ABSTRACT

An existing single-pass sectional boiler is retrofitted with one or two replacement sections to become a multi-pass boiler. One intermediate section of the original boiler is replaced by a new section having a downwardly extending water-filled target wall portion that divides the original combustion chamber into a smaller combustion chamber on the front side and a heat exchange chamber on the rear side of the target wall portion. The target wall portion also forces at least most of the combustion gas to flow from the combustion chamber upwardly through a first flue passage of the boiler's heat exchanger, into the upper flue collector chamber. Another intermediate section of the original boiler may be replaced by a new section having an upwardly extending draft diverter portion, or a draft diverter is installed in the upper flue collector chamber, to divert the flue gas back downwardly through a second flue passage of the heat exchanger to the heat exchange chamber. From there, the flue gas flows again upwardly through a third flue passage of the heat exchanger to the breech.

20 Claims, 6 Drawing Sheets

(56) References Cited

U.S. PATENT DOCUMENTS

| | | | | |
|---|---|---|---|---|
| 4,425,875 | A * | 1/1984 | Marran | F22B 13/005 122/134 |
| 4,671,212 | A | 6/1987 | Smith | |
| 4,852,523 | A | 8/1989 | Zeimes | |
| 4,886,018 | A | 12/1989 | Ferroli | |
| 5,109,806 | A * | 5/1992 | Duggan | F24H 1/32 122/135.2 |
| 5,203,688 | A | 4/1993 | Duggan et al. | |
| 5,261,355 | A | 11/1993 | Scalfi | |
| 5,311,843 | A * | 5/1994 | Stuart | F24H 1/43 122/18.4 |
| 5,437,248 | A | 8/1995 | Miura et al. | |
| 5,787,846 | A | 8/1998 | Schimmeyer | |
| 5,832,846 | A | 11/1998 | Mankowski et al. | |
| 5,890,458 | A | 4/1999 | Kim | |
| 6,257,155 | B1 | 7/2001 | Greene | |
| 6,427,638 | B1 | 8/2002 | Kolbusz et al. | |
| 6,564,756 | B1 * | 5/2003 | Rayes | F22B 7/12 122/110 |
| 6,672,255 | B1 | 1/2004 | Zayas | |
| 6,748,880 | B2 | 6/2004 | DeSellem | |
| 7,137,360 | B1 * | 11/2006 | Zorzit | F22B 13/04 122/235.11 |
| 7,194,963 | B2 | 3/2007 | Ganeshan | |
| 7,290,503 | B2 | 11/2007 | Missoum et al. | |
| 7,311,064 | B2 | 12/2007 | Schimmeyer | |
| 7,669,535 | B2 | 3/2010 | Moskwa et al. | |
| 7,784,434 | B2 | 8/2010 | Gelderloos | |
| 7,827,941 | B2 | 11/2010 | Sumi | |
| 7,900,589 | B2 * | 3/2011 | Gordon | F24H 1/205 122/155.1 |
| 8,191,512 | B2 | 6/2012 | Park | |
| 8,555,821 | B2 | 10/2013 | Morini | |
| 8,807,093 | B2 | 8/2014 | Steinhafel | |
| 8,869,752 | B2 | 10/2014 | Rausch et al. | |
| 9,546,798 | B2 * | 1/2017 | Deivasigamani | F24H 1/145 |
| 9,587,852 | B2 * | 3/2017 | Cordon Urbiola | F24H 9/0026 |
| 9,618,232 | B2 * | 4/2017 | Brown | F24H 1/32 |
| 2009/0165733 | A1 | 7/2009 | Ferguson | |
| 2012/0181006 | A1 | 7/2012 | Angiolini | |
| 2014/0261241 | A1 | 9/2014 | Deckers et al. | |
| 2016/0161144 | A1 | 6/2016 | Van der Klis et al. | |
| 2016/0377320 | A1 | 12/2016 | Kim | |
| 2017/0241667 | A1 | 8/2017 | Teerling et al. | |

OTHER PUBLICATIONS

"MPC (Multi-Pass Commercial)"; http://www.burnhamcommercial.com/products/high-efficiency/mpc/; accessed and printed Sep. 13, 2012.

* cited by examiner

MULTI-PASS BOILER AND RETROFIT METHOD FOR AN EXISTING SINGLE-PASS BOILER

FIELD OF THE INVENTION

The present invention relates to retrofitting and upgrading existing hot water boilers, and especially oil-fired and gas-fired boilers to improve the efficiency thereof. Particularly, the present invention relates to a method and replacement components for retrofitting an existing single-pass boiler to convert it to a multi-pass boiler, as well as a boiler that has been retrofitted in such a manner.

BACKGROUND INFORMATION

Many different configurations and constructions of boilers have become known for burning a fuel to produce heat and transfer a portion of the heat to water, in order to produce hot water or steam. The fuel may be No. 2 heating oil, kerosene, natural gas, propane, coal or wood, for example. The main body or boiler chassis of known "sectional boilers" is constructed of cast metal (e.g. cast iron or aluminum) "sections" that are assembled and connected together by pipe nipples and bolts or threaded rods that pass through all of the sections and clamp them together. Each section has a hollow interior space that communicates with the hollow interior spaces of the other sections when they are all connected together. The hollow spaces for the water-filled boiler jacket of the boiler. Of particular interest in the present application are especially cast iron sectional boilers fired by heating oil, but other metal types and fuel types are also pertinent. For example, instead of cast iron sections, the boiler may be constructed of sections of any metal material that have been formed and produced by casting, forging, powder forging, sintering, pressing, stamping, etc. The hot boiler water is used for domestic or commercial space heating, commercial or industrial process heating, and/or for producing hot domestic or commercial tap water via further heat exchange from the hot boiler water to potable tap waterthrough an additional heat exchanger. Nonetheless, the present application is not limited to such boilers, but rather may also apply to other known constructions and uses of boilers.

A conventional "old-technology" single-pass cast iron sectional boiler 1 is schematically illustrated in FIG. 1 of the drawings of the present application. The boiler 1 includes a fire box or combustion chamber 5, an oil burner unit 8 and a primary heat exchanger 10 of a water-filled jacket above the combustion chamber 5. Sometimes, the water-filled jacket also extends behind and on the sides of the combustion chamber 5, and sometimes also under the combustion chamber (called a wet-base boiler), to provide additional heat exchange surfaces. The water-filled jacket including the primary heat exchanger 10 is formed of several cast iron sections including a front section 10A, a back or rear section 10C, and one or more intermediate sections 10B1, 10B2, etc., which are connected together by pipe nipples, bolts and/or threaded rods that extend all the way through the sections from front to back, as well as optionally gaskets, seals and the like. The front section 10A and the back section 10C each have a specialized individual configuration, but the intermediate sections 10B1 and 10B2 all have the same standardized configuration, and more of these intermediate sections can be provided in order to construct a larger boiler providing a greater heating capacity. The example boiler 1 illustrated in FIG. 1 is known as a four-section boiler, because it includes the four sections 10A, 10B1, 10B2 and 10C. Combustion gas flue passages 11 are formed respectively between successive ones of the boiler sections 10. Namely, in the four-section boiler 1 shown in FIG. 1, a first flue passage 11A is formed between the sections 10A and 10B1, a second flue passage 11B is formed between the sections 10B1 and 10B2, and a third flue passage 11C is formed between the sections 10B2 and 10C. The cast iron sections are typically formed with heat exchange pins, vanes, or fins 18 provided on the surfaces thereof bounding the flue passages 11, in order to increase the surface area of the heat exchanger available for heat exchange between the hot flue gases 20 and the cast iron material, and then through the cast iron ultimately to the water 17 contained in the primary heat exchanger 10 of the water filled jacket.

The burner unit 8 includes a motor driving an oil pump and an air blower, an oil nozzle 9 through which oil is ejected under pressure from the pump, an electric ignition system for igniting the oil ejected from the nozzle, and an electronic control system. The nozzle 9 sprays the high pressure oil in a cone pattern of very fine atomized oil droplets, mixed into a flow of air provided by the air blower. The atomized mist of oil droplets is ignited to produce a combustion flame 19 in the combustion chamber 5. To protect the cast iron boiler jacket or body from the extreme high temperature of the combustion flame 19, and to keep the combustion hot (i.e. insulated from the cool water on the other side of the cast iron combustion chamber wall), the back wall of the combustion chamber 5 is typically covered or lined with a target wall 6, for example of refractory ceramic fiber (RCF) board such as Kaowool™ or Ceraboard™ RCF board. For the same reason, the bottom floor and/or side walls of the combustion chamber 5 are typically covered or lined with an insulation blanket 7 such as a flexible blanket of refractory ceramicfiber (RCF) such as Kaowool™ or Ceraboard™ blanket.

Under proper combustion conditions, the oil should be completely combusted within the combustion chamber 5, to produce hot flue gas 20, which passes upwardly through the primary heat exchanger 10. Namely a first hot gas flow 20A passes upwardly through the first flue passage 11A, a second hot gas flow 20B flows upwardly through the second flue passage 11B, and a third hot gas flow 20C passes upwardly through the third flue passage 11C. In the flue passages, the hot gas gives off some of their heat to the heat exchange pins 18 and the other surfaces of the cast iron sections 10A, 10B1, 10B2 and 10C, and through the cast iron to the water 17 contained in the sections, thereby heating the water. Thus, all of the combustion gas or flue gas 20 has flowed in a single pass through the primary heat exchanger 10, from the combustion chamber 5 upwardly once through the flue passages 11 of the primary heat exchanger 10. The somewhat cooler flue gases are then accumulated or collected in a flue collector chamber or exhaust manifold chamber 12 above the heat exchanger 10. The flue collector chamber 12 is formed and enclosed within a flue collector hood or clean out cover 13 mounted on top of the heat exchanger 10. From there, the collected gases are directed out of the breech or flue outlet 14 of the boiler 1 as exhaust flue gas 21, which is then discharged through a chimney, a power venter, or other exhaust flue arrangement. Also, to reduce heat losses from the boiler to the surrounding ambient environment, the cast iron sections 10 forming the boiler chassis or body are surrounded by a layer of insulation 15 such as fiberglass wool, which is further covered or encased in outer cover panels 16, for example of painted sheet metal.

To achieve maximum efficiency, it is of course desired to extract as much heat as possible from the hot flue gas 20 and transfer it to the water 17 in the heat exchanger 10, thereby cooling the hot flue gas 20 as much as possible, and thus achieving the lowest possible gross stack temperature or breech temperature of the exhaust flue gas 21 at the breech 14. However, it is conventionally taught that the temperature of the exhaust flue gas 21 at the breech of the boiler must remain above at least about 340° F. to avoid problems caused by condensation of water vapor and sulfur components out of the exhaust flue gas 21 in the chimney flue or the like. Namely, the hot flue gas 20 includes water vapor, sulfur, and other components of the heating oil and the combustion air provided through the oil burner unit 8, and at breech temperatures below about 340° F. these components can begin to condense in the chimney flue and form a corrosive acidic liquid condensate that can cause significant corrosive damage and failure of the flue and the cast iron boiler if this condensate drips back down into the boiler. Also, colder spots in the boiler might suffer condensation directly in the boiler. The actual dew point or condensing temperature of the oil combustion vapor is about 117° F., so it must be ensured that the combustion exhaust gases remain above about 120° F. everywhere in the boiler and through the entire length of the exhaust system such as a chimney, until exiting at the top of the chimney. To ensure a chimney top temperature above 120° F., it is typically recommended to maintain a breech temperature at the breech outlet of the boiler above about 335° F. or 340° F.

However, due to inherent inefficiencies in the conventional single-pass sectional boiler 1 shown in FIG. 1, such boilers generally do not achieve such low breech temperatures that condensation problems arise. To the contrary, such boilers typically exhibit an extremely high breech temperature, for example gross breech temperatures in a range from 400° F. to 500° F. or even higher. As a result, much of the heat value of the input heating oil "goes up the chimney" in the form of unnecessarily and excessively hot exhaust flue gas 21, because of less than optimal heat transfer from the hot flue gas 20 to the water 17 through the heat exchanger 10. The first major cause of such inefficiency of the heat transfer is the typical conventional "single-pass" design of the heat exchanger as mentioned above. Namely, the hot flue gas 20 makes only a single pass upwardly through the heat exchanger 10. The hot flue gas 20 divides into three hot gas flows 20A, 20B and 20C, which each respectively pass a single time upwardly through a single flue passage 11A, 11B or 11C respectively, before being collected in the upper flue collector chamber 12 and being exhausted as flue gas 21 out through the breech 14. Thus, the hot flue gas 20 has only a relatively short distance of travel through the heat exchanger 10, and thus only a relatively short residence time in the heat exchanger 10, during which the heat transfer can take place.

Secondly, the heat exchange is also inefficient due to the direction of flow of the hot gas 20 relative to the direction of flow and the temperature stratification of the water 17 in the heat exchanger 10. The hottest water 17 naturally convects to the top of the heat exchanger 10. Also, the cool water returns to the boiler (e.g. from space heating radiators or the like) to a boiler water return inlet 22 connected to the bottom of the boiler water jacket, and hot water is tapped from the boiler through a hot boiler water supply outlet 23 connected to the top of the boiler water jacket. Thus, the flow of water is generally upward through the boiler and especially the heat exchanger 10, with cooler water toward the bottom and hotter water toward the top. The flow direction of the hot gas 20 is also upward through the heat exchanger 10. The hot gas 20 cools as it passes upwardly through the heat exchange passages, and the water 17 heats as it passes upwardly though each heat exchanger section. As a result, the gas 20 near the top of each heat exchanger passage is at its coolest temperature, but the water 17 near the top of the water jacket is at its hottest temperature. The rate of heat transfer between this coolest gas and hottest water is thus relatively low and inefficient. Basically, the heat exchanger is configured as a parallel flow heat exchanger, with both the primary hot fluid (hot gas 20) and the secondary fluid to be heated (water 17) flowing in parallel in the same direction. It is known that such a parallel flow heat exchange configuration is less efficient than a counter-flow heat exchange configuration, in which the two fluids flow generally in opposite directions, for example that the hottest flue gas 20 would be adjacent to the hottest water 17 while the coolest flue gas would be adjacent to the coolest water.

To improve the heat transfer efficiency and thus the overall efficiency, newer boilers with a multi-pass configuration have been designed. In such multi-pass boilers, the flue passages are configured so that the hot flue gas must flow in a serpentine back-and-forth fashion through the primary heat exchanger, through several adjacent flue passages in series one after another rather than in parallel as in the single-pass boiler described above. In such multi-pass boilers, for example boilers manufactured by Burnham and by Biasi, the flue gases typically flow horizontally back-and-forth, namely from the front to the rear of the boiler in the combustion chamber, and then forwardly through one set of flue passages, and then again toward the rear through another set of flue passages, before being exhausted out through the breech at the rear. Such boilers are typically called a three-pass boiler, although there are actually only two passes through heat exchanger flue passages and one pass through the combustion chamber. Such multi-pass sectional boilers can be expanded by adding additional sections as described above, to increase the total length of the boiler. While the flue passages thereby get longer, the boiler remains a three-pass boiler, i.e. no additional back-and-forth passes are provided. Nonetheless, such multi-pass boilers exhibit a significantly higher AFUE (Annual Fuel Utilization Efficiency) in comparison to the older technology single-pass boilers described above and illustrated in FIG. 1.

It has also become known to construct a boiler, particularly a gas fired boiler, to include baffles in the flue passages within each cast iron section to create a serpentine flow passage through the boiler, for example as disclosed in U.S. Pat. No. 5,109,806 (Duggan et al.). While such a boiler only provides a single pass through each boiler section, and only a single pass of the hot flue gas through the heat exchanger, the passage through each section is longer due to the serpentine flow pattern created within that flue passage by the baffles. As another improvement, it is known to provide fins within the passages of heat exchanger sections of a boiler, in order to redirect and distribute the hot gas flow from the combustion chamber into each respective flue passage segment in the boiler, for example as disclosed in U.S. Pat. No. 7,669,535 (Moskwa et al.). It is also known from U.S. Pat. No. 5,311,843 (Stuart) to arrange water flow diverter baffles selectively in the water flow header of a gas-fired water heater in order to achieve a single-pass or multi-pass flow of the water through the water passages of the heat exchanger.

While the above improved features of new technology boilers and water heaters achieve an improved efficiency in comparison to the operating efficiency of existing older technology single-pass boilers, that is unfortunately not directly helpful to the owners of an older single-pass sectional boiler that is otherwise still serviceable and operating well, except for a relatively low efficiency. In view of today's ever-increasing costs of heating oil, there is a strong urge to achieve the greatest efficiency of a heating boiler. The owner of such an older inefficient but serviceable boiler is thus faced with the dilemma of continuing to operate the old inefficient boiler with a higher ongoing operating cost due to the higher consumption of heating oil, or to pay a substantial initial capital cost to replace the old inefficient boiler with a newer more-efficient multi-pass boiler in hopes of achieving a payback of the capital expense over the course of several years in view of reduced operating expenses due to reduced heating oil consumption. Especially in view of the present high cost of heating oil, there is a great demand for avoiding this dilemma, for example by improving the efficiency of the existing older single-pass boiler, at a relatively low cost, without having to completely replace the existing boiler with a new multi-pass boiler.

A low-cost solution to overcome the above dilemma has been provided by U.S. Pat. No. 9,618,232 (Brown), which discloses converting an existing single-pass boiler (such as illustrated in present FIG. 1) to operate in a multi-pass manner. This is achieved by installing a refractory ceramic fiber (RCF) target wall in the existing combustion chamber, and an RCF draft diverter in the upper flue collector chamber. Those RCF components redirect the flue gas to flow in a multi-pass manner through the heat exchanger, namely upwardly through the first/front flue passage, then downwardly through the second/middle flue passage, and then upwardly through the third/rear flue passage. While that conversion method has been shown to achieve significant improvements in boiler efficiency, at a very low cost compared to the cost of a new multi-pass boiler, the solution is only temporary and requires periodic (e.g. annual) maintenance, upkeep and/or replacement of the (essentially temporarily installed) RCF target wall and RCF draft diverter. A more-permanent solution to the above dilemma is desired. Also, while achieving a multi-pass flow of the flue gas through the existing heat exchanger of the boiler, the conversion according to U.S. Pat. No. 9,618,232 does not increase the actual size and surface area of the heat exchange surfaces of the water-filled jacket. It is still desired to achieve further increases in boiler efficiency, and to increase the surface area of the heat exchange surfaces of an existing boiler, with a relatively low-cost retrofit or upgrade of an existing single-pass boiler, without having to purchase an entirely new multi-pass boiler.

Another approach to reduce fuel consumption and slightly increase heat transfer efficiency in an existing boiler is to derate or underfire the burner unit at a lower oil supply rate than the specified burn rate for the boiler. This can usually be accomplished simply by exchanging the burner nozzle with a smaller or lower rated nozzle, e.g. having a smaller nozzle orifice. Thus, the burner will inject and burn oil at a lower rate (e.g. gallons per hour), and also produce less combustion heat energy than the boiler is rated for. The heat exchanger thus becomes effectively bigger in proportion to the produced heat energy, and therefore the heat exchange efficiency increases slightly. This approach is especially applicable if the boiler capacity was originally oversized for the heating demand, or if upgrades to the building's insulation, windows, doors, air-sealing efforts, or the like have reduced the heating demand of the building below the original design heat load. In such cases, derating the oil burner reduces the heat output capacity of the overall boiler system to better match the required heat load, while also achieving slightly improved efficiency. However, such derating of the burner does nothing to address the inherent inefficiency of a single-pass up-flow heat exchanger arrangement of the typical conventional sectional cast iron boiler as discussed above in connection with FIG. 1. The combustion gases still flow too-rapidly through a single pass through the heat exchanger, and much of the available heat energy is simply wasted in the exhaust gas exiting the boiler at a higher temperature than necessary. It is still desirable to further improve the heat transfer efficiency in order to further reduce the boiler breech temperature and stack temperature by extracting more heat from the hot flue gases and transferring that heat to the boiler water.

SUMMARY OF THE INVENTION

In view of the above, it is an object of the present invention to improve the efficiency of an existing single-pass boiler by upgrading and retrofitting it with a limited number of replacement components, while keeping and reusing most of the components of the existing boiler, so as to convert or upgrade it to become a multi-pass boiler that operates with multiple passes of the hot flue gas through successive flue passages of the boiler's heat exchanger in series one after another. Another object of the invention is to provide a new multi-pass boiler construction that is substantially based on an existing single-pass boiler design, but includes only a few different components, so that such a new boiler can be manufactured economically. The invention further aims to avoid or overcome the disadvantages of the prior art, and to achieve additional advantages, as apparent from the present specification. The attainment of these objects is, however, not a required limitation of the claimed invention.

The above objects have been achieved according to the invention by replacing preferably only one or two sections of a previously existing single-pass sectional boiler with a new replacement section or sections that have a different configuration compared to the original boiler sections, for upgrading and retrofitting the existing boiler to become a multi-pass boiler in which the hot flue gases flow through the primary heat exchanger of the boiler three times in series or sequence after one another.

In the existing single-pass boiler, all of the boiler chassis sections forming the water-filled jacket including the primary combustion chamber typically each have an upper end or edge that terminates on the same common plane forming the top of the heat exchanger and the top of the boiler chassis. Above the top of the heat exchanger, a flue exhaust collector hood and clean-out cover forms a flue collector chamber that acts as a manifold and collects the hot flue gases from all of the flue passages. Alternatively, all of the boiler sections have an axially extending opening that forms the flue collector chamber. Throughout this disclosure the axial direction and references to "axially extending" refer to the direction in which the tie rods extend through all of the boiler sections to connect them together (i.e. the direction perpendicular to the planes of the boiler sections, corresponding to the left-right direction in FIG. 1). Furthermore, in a wet-base boiler, all of the boiler sections, or all of the boiler sections other than the back section, near the bottom thereof have an axially extending opening that forms the combustion chamber below, and communicating upwardly into, the flue passages that are formed respectively between the successive sections at the primary heat exchanger portion thereof. Alternatively, in a dry-base boiler, all of the sections, or all of the sections other than the back section, have a bottom end or edge that terminates on a common plane, leaving an open space as the combustion chamber below this plane.

The retrofit upgrade according to the present invention involves replacing essentially only one or two intermediate sections (between the front section and the back section) of the existing boiler. One existing intermediate section is replaced with a first replacement section or new target wall section that is basically the same as the existing section except that it includes an additional target wall portion that extends downwardly from the primary heat exchanger into the previously existing combustion chamber, and thereby forms a partition or dividing wall that divides the previously existing combustion chamber into a smaller reduced combustion chamber on the front side of the extended target wall portion, and a heat exchange chamber on the back side of the extended target wall portion. Another one of the existing intermediate sections of the existing boiler may be replaced with a second replacement section or new draft diverter section that is generally the same as the previously existing section except that it additionally includes an extended upper draft diverter portion that extends upwardly from the heat exchanger and thereby divides the previously existing flue collector chamber into two smaller chambers respectively on the front side and the back side of the extended upper draft diverter portion. Alternatively, instead of replacing the second intermediate section, that existing section is also kept and reused, and an upper draft diverter is installed in the upper draft collector chamber above that existing second intermediate section.

After such a retrofit, the downwardly extended target wall portion of the target wall section causes all or most (e.g. an adjustable portion) of the hot combustion gas to flow from the combustion chamber upwardly through a first flue passage (or passages) of the heat exchanger. The upwardly extended draft diverter portion of the draft diverter section, or the separate upper draft diverter, causes all or most (e.g. an adjustable portion) of the hot flue gas to flow from the upper flue collector chamber downwardly through a second passage or passages of the heat exchanger into the heat exchange chamber that has been formed in the back portion of the original combustion chamber. From there, the flue gases flow upwardly through a different passage or passages of the heat exchanger to the flue outlet.

The new replacement section or sections, i.e. the target wall section and the draft diverter section, are formed of cast iron (or other metal) just like the original sections that they are replacing. The new sections also have the same dimensions and configuration of the sections that they are replacing, except for the additional extended portions, i.e. the extended target wall portion and the extended upper draft diverter portion respectively on the two replacement sections. Thus, the new sections can easily directly replace the old intermediate sections. The remaining original components of the existing boiler can be kept and reused when reassembling the boiler into its upgraded configuration in which the two new sections have replaced two of the original intermediate sections of the boiler. Thus, the front section, the back section, possibly one or more intermediate sections, the tie rods and other hardware, the outer insulation, the outer cover panels, the exhaust flue connection, burner unit, plumbing connections, electrical connections and electrical control system can all be reused. As a result, retrofitting and upgrading an existing single-pass boiler into the upgraded multi-pass configuration is much less expensive than replacing the existing boiler with a completely new multi-pass boiler. Moreover, this retrofit of the boiler achieves a permanent and durable upgrade, which will not need periodic replacement of the draft diverting components (target wall portion, and draft diverter portion or upper draft diverter) in order to maintain the multi-pass operation of the boiler. Instead, the boiler has been permanently reconfigured and upgraded from being a single-pass boiler to being a multi-pass boiler.

The retrofitted and upgraded boiler is more efficient than the previous existing single-pass boiler because of the multi-pass gas flow through the primary heat exchanger. A further increase of efficiency is achieved because the extended upper draft diverter portion of the draft diverter section and the extended target wall portion of the target wall section are preferably hollow water-filled portions of the water jacket, so that these portions increase the total available heat exchange area of the water jacket. It is further believed that the combustion efficiency is also improved, because the resulting smaller combustion chamber heats up very quickly and achieves a very high and very uniform combustion temperature with a more compact combustion flame.

BRIEF DESCRIPTION OF THE DRAWINGS

In order that the invention may be clearly understood, it will now be explained in further detail in connection with example embodiments thereof, with reference to the accompanying drawings, wherein.

DETAILED DESCRIPTION OF PREFERRED EXAMPLE EMBODIMENTS AND OF THE BEST MODE OF THE INVENTION

Figure 1:
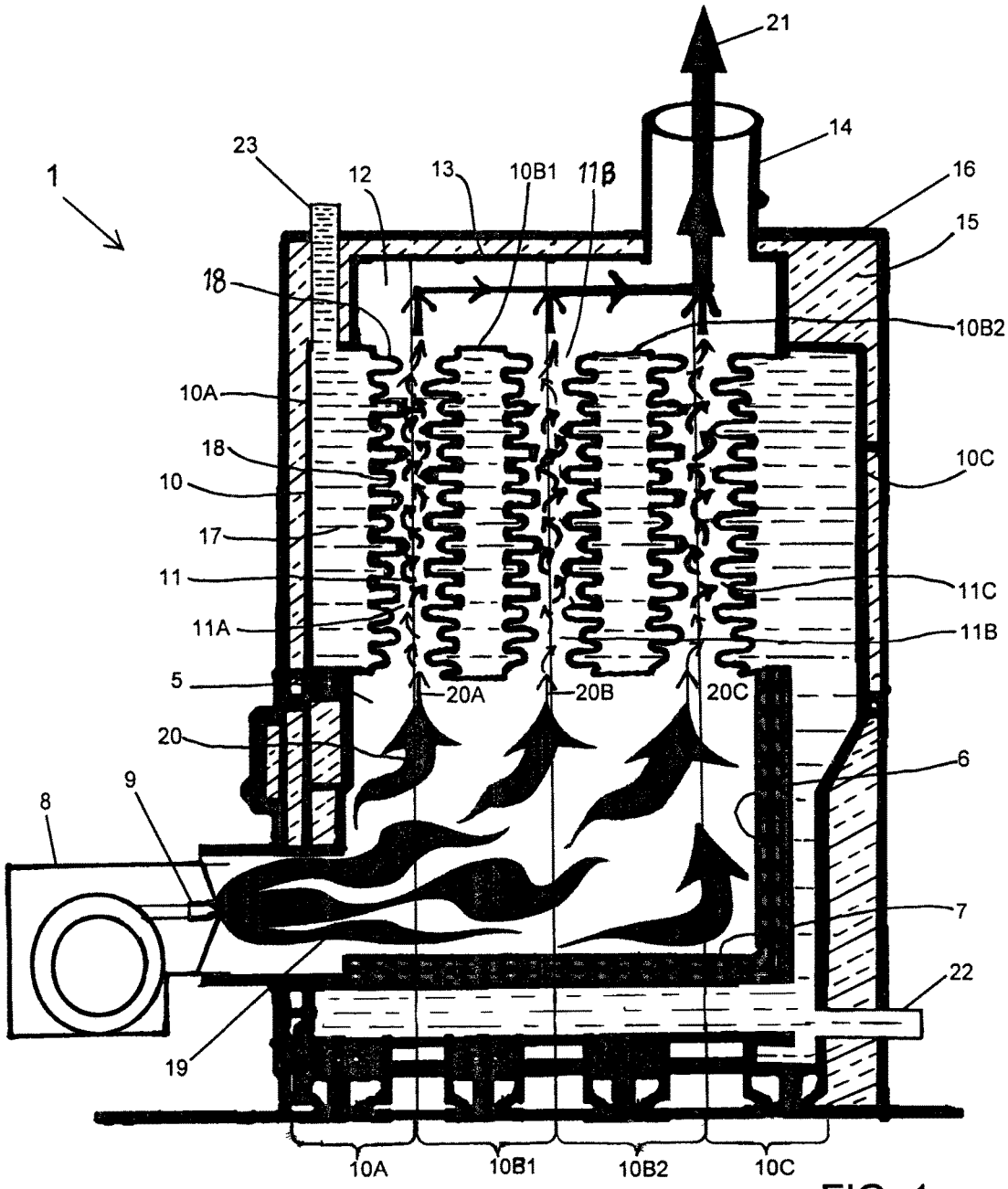
FIG. 1 PRIOR ART
FIG. 1 is a schematic sectional side view of a conventional single-pass cast iron sectional boiler having four cast iron sections forming three flue passages through the primary heat exchanger of the boiler.
Figure 2:
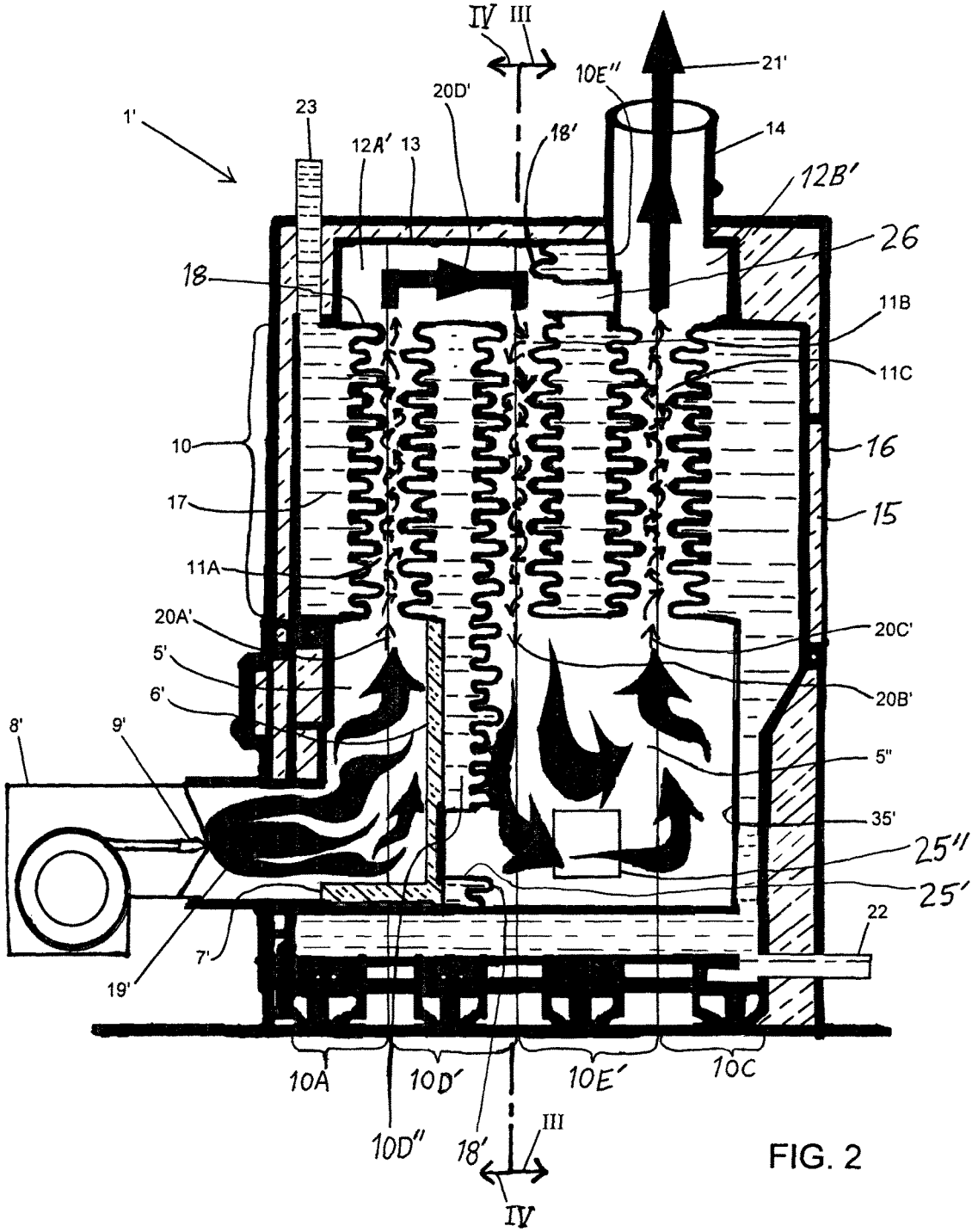
FIG. 2 is a schematic sectional side view of the four-section cast iron boiler of FIG. 1, retrofitted with two replacement sections according to the invention, whereby it has been upgraded and converted into a multi-pass boiler with a multi-pass flue gas flow through the three flue passages of the primary heat exchanger.

The conventional single-pass cast iron sectional boiler shown schematically in FIG. 1 has been discussed above. That conventional boiler 1 will be retrofitted with replacement components (and optional operating parameter modifications) according to an embodiment of the invention to produce the upgraded multi-pass boiler 1' with the modified inventive configuration as shown in FIG. 2. Most of the components and features of the inventive modified boiler 1' correspond to the conventional boiler 1, and a description thereof will not be repeated. The above description applies here as well. The same reference numbers are used in the inventive boiler 1' in FIG. 2, for the same components of the conventional boiler 1 of FIG. 1 that have been kept and re-used for the inventive boiler 1'. Replacement components and modified features are labeled with the same reference number supplemented by a prime mark (') or a double prime mark ("). Additional components or features are identified by additional reference numbers in FIG. 2.

In this embodiment of FIG. 2, the previously existing boiler 1 has been retrofitted by the installation of two cast iron replacement sections 10D' and 10E' to replace two intermediate sections 10B1 and 10B2 of the existing boiler 1 of FIG. 1. The two replacement sections divert the draft and flow path of the hot flue gas (and make additional modifications to be discussed below) to achieve a multi-pass gas flow through the primary heat exchanger 10 in the retrofitted or upgraded boiler 1', instead of the single-pass flow of hot flue gas through the heat exchanger 10 that existed in the conventional boiler 1. Except for the two replacement sections of the boiler chassis, essentially all of the other components of the previously existing boiler can be kept and re-used for assembling the retrofitted and upgraded boiler 1'. The retrofitting procedure is thus much less expensive than entirely replacing the previously existing single-pass boiler with some other model of new multi-pass boiler. Nonetheless, the inventive retrofitting procedure is no more difficult than disassembling and removing the previous existing boiler, and then assembling and installing an entirely new boiler. In fact, the retrofit procedure according to the invention is simpler, less time-consuming and less expensive than assembling and installing a complete new boiler, because all of the plumbing connections, electrical and control connections, and the combustion gas outlet connection can all be maintained as they were previously in place. Because the boiler chassis itself is retrofitted and upgraded with two replacement sections that are just as durable and permanent as the original cast iron sections that they replace, the inventive retrofitting is a permanent and durable upgrade of the boiler to a multi-pass configuration, and future servicing and maintenance of the boiler is similar to the servicing and maintenance that was required for the previous existing single-pass boiler. Nonetheless, due to the multi-pass flue gas flow through the primary heat exchanger, and due to the enlarged surface area available for heat exchange by the water-filled jacket, the heat transfer and thus the efficiency of the upgraded boiler will be significantly improved compared to the previous existing boiler.

The details of the retrofit and modifications will now be explained with reference to FIG. 2 in comparison to FIG. 1. In the existing single-pass boiler 1 shown in FIG. 1, the four cast iron sections 10A, 10B1, 10B2 and 10C are held together by threaded tie rods (not shown) that extend perpendicularly through all of the sections in the left-right direction in FIG. 1. The retrofit procedure proceeds by disconnecting plumbing connections 22 and 23 and draining the boiler 1, removing the burner unit 8, disconnecting the exhaust gas flue outlet 14 from the chimney (or power venter) flue pipe, removing the flue collector hood 13, the outer cover panels 16 and the insulation 15 to expose the boiler chassis or water jacket, removing the RCF target wall 6 and insulation blanket 7 from the combustion chamber 5, removing the tie rods, and separating the cast iron sections 10A, 10B1, 10B2 and 10C from each other. The intermediate sections 10B1 and 10B2 will not be kept and re-used, so these can be discarded or recycled. The front section 10A and the back section 10C may be thoroughly cleaned and inspected at this time. The new replacement sections 10D' and 10E' (namely the target wall section 10D' and the draft diverter section 10E') are arranged or stacked in order between the previous existing front section 10A and the previous existing rear section 10C, and the threaded tie rods are again installed to secure the sections to one another. To the extent required for the particular boiler model and installation, any necessary gaskets, seals, etc. are replaced when assembling the boiler chassis sections to one another. Once the boiler chassis has been reassembled in the above manner, then the outer insulation 15 and the outer cover panels 16 and the flue collector hood 13 are again installed, and the breech or flue outlet 14 is reconnected to the existing chimney or power venter flue. The boiler water return inlet 22 and the boiler water supply outlet 23 are reconnected to the existing plumbing connections, and various electrical controls are reconnected as well. A target wall RCF insulation 6' is installed onto the front side of the extended target wall portion 10D" of the target wall section 10D', and an insulation blanket 7' is installed on the floor of the resulting smaller or reduced combustion chamber 5'. Then the burner unit 8 including the nozzle 9, or preferably with slight modifications (as discussed in detail below) the modified burner unit 8' with the nozzle 9' can be reinstalled on the boiler.

Comparing FIGS. 1 and 2, it can be seen that the new target wall section 10D' has a downwardly extending target wall portion 10D" that has divided the previous existing combustion chamber 5 into a smaller or reduced combustion chamber 5' on the front side of the target wall portion 10D", and a heat exchange chamber 5" on the back side of the target wall portion 100". The reduced combustion chamber 5' has a depth or length, in the horizontal or axial direction, of e.g. about one-third or from 25% to 40% of the total length of the heat exchanger 10 in the horizontal or axial direction. Considered differently, the rear heat exchange chamber 5" is preferably from 1.5 to 3 times as long as the combustion chamber 5' in the horizontal or axial direction.

An RCF target wall insulation 6' and an RCF insulation blanket 7' are installed in the combustion chamber 5' to protect, respectively, the cast iron target wall portion 10D" and the cast iron floor of the combustion chamber 5' from the intense heat, and to help keep the combustion therein hot and clean. Because the reduced combustion chamber 5' is quite short, it is recommended to use thicker-than-usual RCF target wall insulation 6'. Furthermore, the target wall portion 10D" is preferably water-backed, i.e. hollow and filled with water, to prevent overheating and burn-through of the cast iron. The smaller size of the reduced combustion chamber 5' creates a relatively small, intensely hot, shortened combustion flame 19' of the fuel oil and air mixture injected by the nozzle 9' of the burner unit 8', and the smaller combustion space 5' heats up very quickly after startup, and thus quickly reaches the most efficient combustion operation. This also seems to achieve a very efficient and thorough combustion, based on simulation experiments in which a reduced amount of soot, ash, scaling etc. was found in the combustion chamber and the heat exchanger after creating such a reduced-size combustion chamber. It further appears that the temperature throughout this smaller combustion chamber 5' is higher and more uniform than the distribution of temperatures throughout the larger original combustion chamber 5 of the conventional boiler 1. It is believed that this high uniform temperature ensures thorough combustion of the fuel.

In the illustrated embodiment, the front surface of the target wall portion 10D" is a flat planar surface. Alternatively, the target wall portion 10D" could be curved or dished, concavely or convexly, on the front surface and/or on the back surface, e.g. to influence the gas flow and swirl pattern of the combustion flame 19' in the combustion chamber 5' and/or the flue gas flow 20B' to 20C' in the rear heat exchange chamber 5".

Because the new, essentially enclosed, heat exchange chamber 5" has been formed on the back side of the target wall portion 10D", it is necessary to provide access to this chamber 5" for the purpose of inspecting and cleaning out soot and scale (e.g. by brushing and vacuuming) during regular (e.g. annual) maintenance of the boiler. Some boilers already include a rear clean-out hole 25 (see FIG. 5), and will not require any further modification in this regard. On the other hand, for an existing boiler that does not include a rear clean-out hole, it will be necessary to provide a front-access clean-out hole 25' with an openable (e.g. removable) cover plate through the target wall portion 10D" of the replacement section 10D', and/or a side-access clean-out hole 25" through the side wall portion of the replacement section 10E', as shown in FIG. 2. In either case, such an opening 25' and/or 25" can easily be provided when casting the new replacement section 10D' and/or 10E'.

Furthermore, the downwardly extending target wall portion 10D" of the target wall section 10D' preferably forms an air-tight sealed partition between the reduced combustion chamber 5' and the heat exchange chamber 5", because the section 10D" is tightly clamped and sealed between the section 10A and the section 10E'. This forces all of the combustion gases of the shortened combustion flame 19' to flow as diverted hot flue gas 20A' upwardly through the first flue passage 11A of the primary heat exchanger 10 of the boiler 1'. As the diverted hot flue gas 20A' flows through the first flue passage 11A, heat is transferred via the pins 18 of the primary heat exchanger 10 (i.e. on the walls of the front section 10A and the target wall section 10D'), to the water 17 contained in these sections. The somewhat cooler flue gas 20D' enters a flue gas diverting chamber 12A' formed in the front portion of the flue collector chamber 12 on the front side of the draft diverter portion 10E" of the draft diverter section 10E' of the boiler chassis. The upwardly extending draft diverter portion 10E" diverts the flue gas 20D' to flow downwardly through the second flue passage 11B formed between the target wall section 10D' and the draft diverter section 10E'. During that, additional heat is extracted from the flue gas and transferred into the water 17 in those boiler chassis sections. The flue collector hood or clean-out cover 13 of the boiler is preferably (but not necessarily) tightly sealed around the upper and side perimeter of the upwardly extending draft diverter portion 10E" of the draft diverter section 10E', e.g. with gasket or seal material, so that the draft diverter portion 10E" can force all of the flue gas to flow downwardly through the second flue passage 11B.

On the other hand, in certain applications it may be necessary or desirable to purposely allow some bypassing of the multi-pass flue gas diversion, for example if the temperature of the exhaust gas 21' at the breech 14 is too low with 100% multi-pass flow, or if the single flue passage 11A, 11B or 11C does not provide sufficient cross-sectional area to flow the entire combustion gas stream therethrough while maintaining the required over fire draft and breech draft values. In such a situation, gas leakage may be allowed around the edges of the upwardly extending draft diverter portion 10E" of the draft diverter section 10E', or a bypass opening 26 may be provided in the draft diverter portion 10E" as shown in FIG. 2. This bypass opening 26 may also be covered with an adjustable cover plate, which may be adjusted by sliding, rotation, or tilting, to adjust the amount of bypass gas flow that is permitted to flow directly from the front flue gas diverting chamber 12A' to the rear breech chamber 128', through the bypass opening 26, thereby bypassing the second flue passage 11B and the third flue passage 11C. Similarly, an adjustable bypass opening may be provided through the downwardly extending target wall portion 10D" of the target wall section 10D' (not shown, but e.g. through the cover plate of the clean-out opening 25'), to permit an adjustable amount of combustion gas to flow directly through this bypass opening from the reduced combustion chamber 5' into the additional heat exchange chamber 5". In effect, such bypass openings will allow a small portion of the total combustion gases to flow in a single-pass through the heat exchanger. Furthermore, by allowing some bypass flow through the upper draft diverter portion and/or through the target wall portion in this manner, it is possible to adjust the over-fire draft, the breech draft, and the temperature of the exhausted gas flow 21' at the breech 14 as required to achieve the desired gross stack temperature value to avoid condensation while achieving the maximum possible efficiency. Namely, the more hot flue gas that is allowed to bypass the upper draft diverter and the target wall and thus make a single pass through the heat exchanger, the higher the stack temperature and the draft will be. The lowest stack temperature and highest efficiency are achieved by ensuring 0% bypass flow and 100% flue gas diversion into the multi-pass flow configuration.

As further shown in FIG. 2, the flue gas 20B' that has been diverted to flow downwardly through the second flue passage 11B then enters and swirls through the additional heat exchange chamber 5" in the rear part of the original combustion chamber, i.e. on the back side of the downwardly extending target wall portion 10D" of the target wall section 10D'. In this area, the back side of the target wall portion 10D" is preferably (but not necessarily) provided with additional heat exchange pins 18', and this target wall portion is hollow and water-filled just like the other portions of the boiler chassis sections. Thereby, the heat exchange surface area of the overall boiler water jacket is increased, to provide additional extraction of heat from the flue gases. Furthermore, because the original target wall insulation 6 and the floor insulation blanket 7 have been removed from the rear portion of the original combustion chamber, those walls of the water jacket are also exposed as additional heat exchange surfaces in the chamber 5". This is especially advantageous in a boiler designed as a wet back and/or wet base boiler, in which the water-filled jacket extends also along the back wall and/or under the floor of the original combustion chamber, for example as schematically illustrated in FIG. 2. As another option, if the back section 10C is to be replaced with a replacement section (e.g. to provide a rear clean-out hole as described above), then it would be possible to provide additional heat exchange pins 18' also on the lower surface of the replacement back section bounding the heat exchange chamber 5". Thus, compared to the previous existing boiler 1 shown in FIG. 1, additional heat transfer can take place between the hot flue gases and the water jacket as the flue gases 20B' swirl through this additional heat exchange chamber 5". Then the gases 20C' flow from the chamber 5" upwardly through the third flue passage 11C, where additional heat is transferred from the gases to the water 17 in the heat exchanger 10, until finally the cooled exhaust gas 21' is discharged through the breech or flue outlet 14. While the flue outlet 14 is illustrated at the top of the boiler 1' in FIG. 2, it should be understood that this outlet could instead be on the back or the side of the boiler.

As a result of the repeated passage (three times, 11A, 11B, 11C in succession) through the primary heat exchanger 10, and due to the additional heat exchange with the additional water-filled target wall portion 10D" and water-filled upper draft diverter portion 10E", and the additional heat exchange in the chamber 5", the exhaust gas flow 21' exiting the breech 14 of the inventive retrofitted boiler 1' is at a lower exhaust gas temperature than the exhaust gas 21 exiting the conventional single-pass boiler 1 of FIG. 1. The cooler exhaust gas temperature at the breech means that more energy has been transferred from the hot flue gas to the water 17 in the boiler water jacket. This in turn means a higher efficiency, energy savings and cost savings are achieved by the inventive retrofitting, because less fuel oil will have to be burned to achieve the same BTUs of heat transferred into the boiler water 17. Because the flue gas 20C' passing through the third flue passage 11C will have a rather low temperature, which might result in condensation at any "cold spots" when the water in the water jacket is cold (e.g. upon initial startup of a cold boiler), it can be advantageous to provide an anti-corrosion coating on the pins 18 and surfaces of the flue passage 11C.

Figure 3:
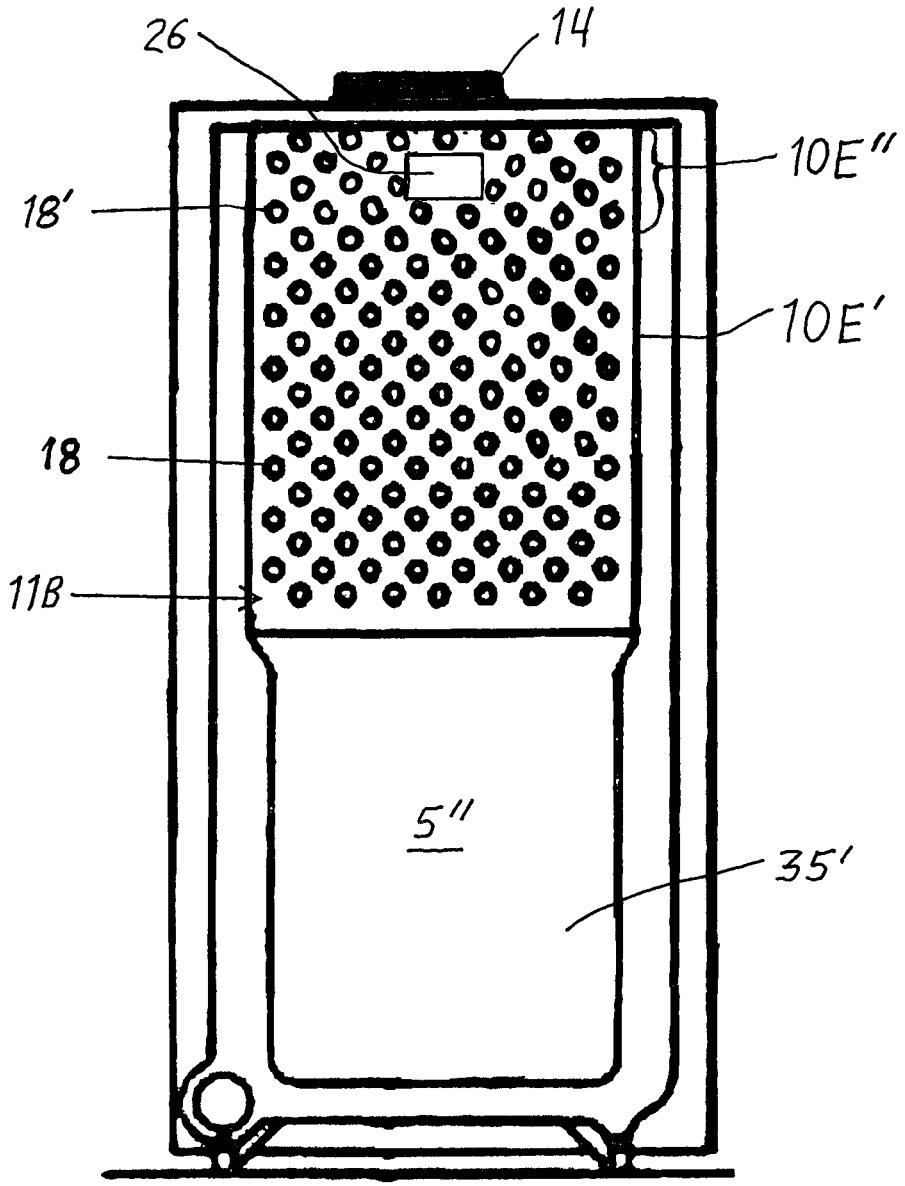
FIG. 3 is a schematic sectional front view of the inventive upgraded boiler according to FIG. 2, taken along the section line III-III in FIG. 2.
Figure 4:
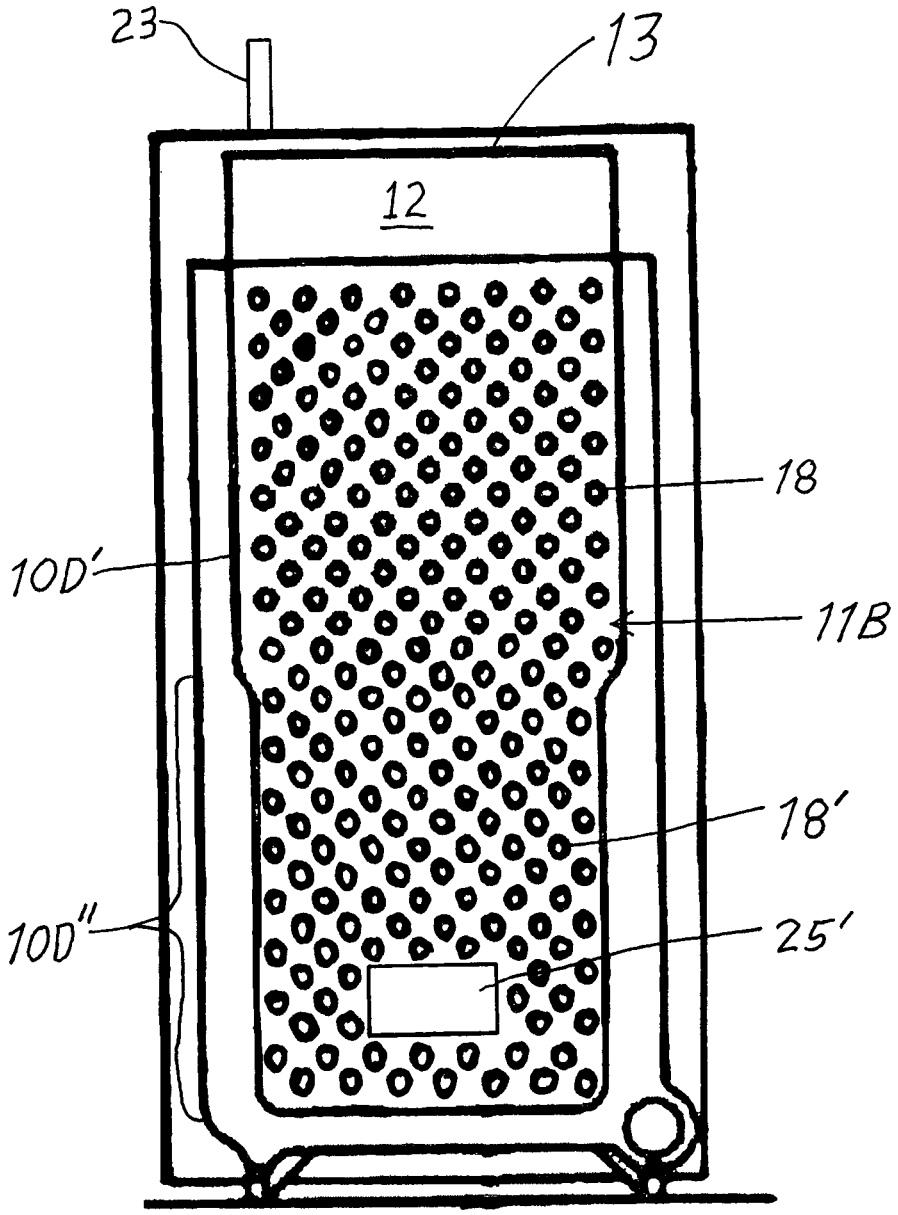
FIG. 4 is a schematic sectional rear view of the inventive upgraded boiler according to FIG. 2, taken along the section line IV-IV in FIG. 2.

FIGS. 3 and 4 respectively show the upper draft diverter section 10E' and the target wall section 10D' as seen in an axial direction. Namely, FIG. 3 is a sectional view through the boiler as seen looking toward the right on the section line III-III as indicated in FIG. 2, and FIG. 4 is a sectional view of the boiler looking toward the left on the section line IV-IV as indicated in FIG. 2.

FIG. 3 shows that the upwardly extending draft diverter portion 10E" of the replacement section 10E' has additional heat exchange pins 18', while the main body portion of the replacement section 10E' has heat exchange pins 18 just like the original intermediate section 10B2 that was replaced by the replacement section 10E'. The (optional) adjustable bypass opening 26 in the upwardly extending draft diverter portion 10E" is further schematically shown in FIG. 3.

FIG. 4 shows that the downwardly extending target wall portion 10D" has additional heat exchange pins 18', while the main body portion (forming the primary heat exchanger 10) of the replacement section 10D' has heat exchange pins 18 similarly to the intermediate section 10B1 of the original boiler 1 that has been replaced by the replacement section 10D'. Thus, the downwardly extending water-filled target wall portion 10D' significantly increases the total heat exchange area of the boiler water jacket by providing an additional pinned surface that the flue gasses 20B' flow along as they enter downwardly into and swirl back up around the newly created heat exchange chamber 5". The water in the target wall portion 10D" also receives additional heat from the front, i.e. from the combustion chamber 5', even though RCF insulation 6' is provided there to insulate against and moderate the extremely high temperature of the combustion flame 19'. The (optional) clean-out hole 25' provided in the target wall portion 10D" is also schematically shown in FIG. 4. This clean-out hole can additionally serve as the (optional) bypass opening if it is provided with an adjustable cover plate, and an opening through the insulation 6'. In this case, it may be necessary to also provide a sleeve of insulation in the hole 25'.

Furthermore, because a higher percentage of the energy value or energy content of the heating oil fuel is extracted, therefore a lower fuel oil input rate is required to satisfy the same heating demand. Furthermore, as mentioned above, if the original boiler was oversized for the required heat load, or if insulation upgrades or other improvements were made to the building serviced by the boiler, then it is further possible to derate the burner input. Such a derating or reduction of the fuel injection rate of the burner also goes hand-in-hand quite well with the inventive updating of the boiler to achieve a draft diversion that provides a multi-pass flue gas flow through the heat exchanger of the boiler. Namely, because all of the flue gas is forced to flow upwardly through typically one-third of the total number of flue passages, and then downwardly through one-third of the total number of flue passages, and then again upwardly through one-third of the total number of flue passages, the cross-sectional flow area of the flue is substantially restricted compared to the original total flue made up of plural e.g. three flue passages in parallel with each other. That reduction of the cross-sectional flow area reduces the draft over the fire in the combustion chamber. Thus, after the retrofitting and upgrading of the boiler with the target wall section 10D' and the draft diverter section 10E' installed instead of two intermediate sections 10B1 and 10B2, it may not be possible to fire the boiler at the same fuel injection rate for which it was originally designed or rated because the over-fire draft might not be sufficient. On the other hand, because of the increased heat transfer, it will not be necessary to fire the boiler at its original high firing rate, in order to achieve the same heat output. Also, in many situations, for example a boiler with a chimney (e.g. with an insulated stainless steel liner) that provides adequate natural convective draft, or with a power venter to produce a mechanically induced draft, or with a burner (e.g. Riello™) that fires with a forced draft, there will be adequate over-fire draft in the combustion chamber even after the retrofitting of the boiler. In such situations, the burner can be fired at its original designed rate, and will simply operate for a reduced time or duty cycle after the retrofitting as compared to beforehand, for producing the same BTU output of the boiler. Nonetheless, even in such situations, it may be desired to derate the burner and/or make further changes (e.g. changing the nozzle cone angle and/or the fuel injection pressure) as described below, for improving the combustion characteristics further in the smaller combustion chamber 5' that is formed by the retrofit.

Derating the burner can be achieved simply by replacing the original fuel injection nozzle 9 with a replacement nozzle 9' having a smaller orifice and a decreased fuel delivery rating, for example switching from a nozzle 9 rated for 1.25 gph or 1.1 gph, to a replacement nozzle 9' rated to deliver 0.85 gph. A typical firing rate of 1.25 gph for a four section boiler will generally be reduced to a range of about 0.85 gph to about 1 gph according to the invention. Furthermore, through testing it has been found to be advantageous and preferable to change the oil injection cone pattern or angle, especially to a narrower cone angle. This is also achieved by selecting a suitable replacement nozzle 9', for example such a nozzle providing a narrower 45° cone angle rather than the typical 80° cone angle of the original nozzle 9. It has been found that such a narrower oil spray cone pattern also achieves a narrower and tighter combustion flame 19', which strikes against the closer target wall insulation 6' and curls back in a swirling manner like backwash from a waterfall falling into a pool below the waterfall. Such a flame pattern has been found to achieve a very high and uniform temperature throughout the new smaller combustion chamber 5', and result in very good complete combustion of all of the oil. This also helps to ensure that the combustion flame 19' is contained within the combustion chamber 5' and does not extend further upward into the colder heat exchanger 10, thereby helping to prevent or reduce sooting of the flue passage 11A. The target wall insulation 6' also becomes glowing red hot a short time after ignition of the combustion flame 19', and this further helps to maintain a very high temperature environment in the smaller combustion chamber 5', which further aids in complete combustion of all of the injected oil.

Furthermore, it has been found to be advantageous in some installations, to increase the oil supply pressure, as supplied by the oil pump in the burner unit 8', compared to the original pressure setting of the burner unit 8 of the unmodified boiler 1. By increasing the oil pressure and reducing the nozzle size, the oil droplets in the spray cone are more thoroughly atomized in the form of finer oil droplets. While the increased oil pressure also increases the delivery rate of oil through the nozzle, this is counterbalanced by the smaller orifice size of the nozzle. These parameters are selected as necessary to achieve the desired oil injection rate, oil droplet atomization, oil spray cone angle, and flame pattern. The overall result achieves very thorough and complete combustion of the oil, and reduced oil consumption, which contributes to the energy savings and cost savings achieved according to the invention.

A further advantageous effect and contribution to the increased efficiency relates to the flow direction of the hot flue gases relative to the flow direction of water 17 through the boiler. As described above in connection with FIG. 1, the cooler return water enters the boiler at the return fitting 22, and flows generally upwardly and from the rear to the front of the boiler, to exit as hot water at the boiler supply fitting 23 at the top front of the boiler water jacket. Thus, the water flow is generally from the lower right to the upper left in FIG. 2, and the water becomes progressively warmer as it flows in that direction. On the other hand, in the inventive retrofitted boiler 1', the hot flue gases flow first upwardly through the first flue passage HA, then downwardly through the second flue passage 11B, and then upwardly through the third flue passage 11C. The flue gasses become progressively cooler as they flow back-and-forth through the heat exchanger 10. The overall gross flow direction of the flue gases is thus from the lower left in the combustion chamber 5' to the upper right to exit the boiler through the breech or flue outlet 14. Thus, the gas flow from left to right through the boiler is contrary to the water flow from right to left through the boiler, and the gas cools down from left to right, while the water heats up from right to left. Thus, the flow of the two fluids through the heat exchanger 10 is generally in a counter-flow arrangement, which is more efficient, because the already-cooled gas in the third flue passage 11C can give up the last of its heat to the coolest water on the right side of the boiler, while the hottest flue gas in the first flue passage 11A can give off heat to the water on the left side of the heat exchanger even though that water is already approaching its highest temperature. All of the directions (e.g. right and left) mentioned here are with reference to the illustration in FIG. 2. Such a flow pattern also helps to protect the boiler against cold water shock, because the hottest flue gases are adjacent to the hottest water, and the coldest water entering the boiler is adjacent to the cooler flue gas. There is no direct shock of the coldest water meeting the hottest gases on opposite sides of a cast iron wall at one spot within the boiler. As a further alternative option, the inventive modification may also include provision of a recirculation loop with a circulator to circulate the water through the boiler water jacket and thereby maintain the above described flow direction, or alternatively to achieve and maintain a more-even temperature throughout the boiler if that is desired for a particular application.

Additional modifications according to the invention relate to the venting of the boiler or heating appliance. As mentioned above, the multi-pass flue gas flow resulting in the retrofitted boiler 1' necessarily imposes a greater constriction or restriction on the flue gas flow through the heat exchanger. As a result, this tends to reduce the draft through the retrofitted or upgraded boiler 1' compared to the original operating parameters of the unmodified boiler 1.

Also, because the exhaust flue gas 21' exiting a modified boiler 1' is cooler than the exhaust flue gas 21 exiting the unmodified boiler 1, the buoyancy and natural draft created by the flue gas exhausting upwardly through a conventional chimney is also correspondingly reduced. This would further tend to reduce the natural draft through the modified boiler 1'. Nonetheless, it has been found that derating the burner, i.e. reducing the oil injection rate, as discussed above may be adequate to maintain the required draft values over the fire and at the breech. If not, a further recommended modification according to the invention is to install an insulated stainless steel chimney liner into the original natural draft chimney connected to the boiler, especially if it is an exterior uninsulated chimney. The insulated liner will achieve an increased natural draft, and will also maintain the exhaust gas temperature better throughout the height of the chimney, thereby further helping to avoid condensation of the oil combustion exhaust gases. Also, the stainless steel liner will be resistant to corrosion even if some minimal condensation of exhaust components occurs, for example at the top outlet of the chimney. Alternatively, another modification according to the invention involves providing a power venter, i.e. an electrically powered vent fan for direct venting of the boiler instead of natural draft venting via a chimney, or a draft induction fan to increase the draft provided by a chimney. One proposed arrangement according to the invention involves adding a powered draft inducer fan directly to the flue outlet collar of the flue outlet 14. Alternatively, the inventive modifications are especially suitable for use in connection with any conventional direct vent or power vented boiler arrangement. Such boiler arrangements have a forced draft that can be easily adjusted to achieve the required draft values. These considerations also apply for sealed combustion boiler and burner arrangements or any other boiler arrangement allowing a positive draft pressure value over the fire in the combustion chamber. When making the required adjustments, it must simply be taken into account that there will be an additional constriction on the flue gases passing through the heat exchanger.

Furthermore, while the inventive arrangements have been discussed in connection with oil-fired boilers, the same or similar replacement components (e.g. the boiler sections with an extended target wall and with an extended upper draft diverter respectively), modifications, features, characteristics, method steps and concepts also apply to gas-fired boilers, and especially those with power burners that positively create the required draft with a powered blower. The inventive teachings also apply in the same manner to old-fashioned single-pass multi-passage boilers that are fired with wood, pellets, coal, etc., as long as one or two sections of the original boiler can be replaced by differently configured sections to result in a multi-pass flow of the flue gases through the heat exchanger.

With the teachings of the present embodiment of this invention, a person of ordinary skill in the art is able to retrofit and thus permanently upgrade an existing "old-fashioned" relatively inefficient single-pass boiler to become a multi-pass boiler with increased efficiency and decreased oil consumption. Thus, the owner of an older inefficient single-pass boiler is no longer faced with the dilemma of continuing to send money up the chimney in the form of wasted (uncaptured) heat value, or facing a high up-front capital expenditure to replace the old inefficient boiler with a complete new efficient multi-pass boiler. Instead, the homeowner can keep almost all of the components of the old and serviceable yet inefficient single-pass boiler, and have the boiler upgraded into a more-efficient multi-pass boiler simply by replacing two chassis sections of the old boiler.

Figure 5:
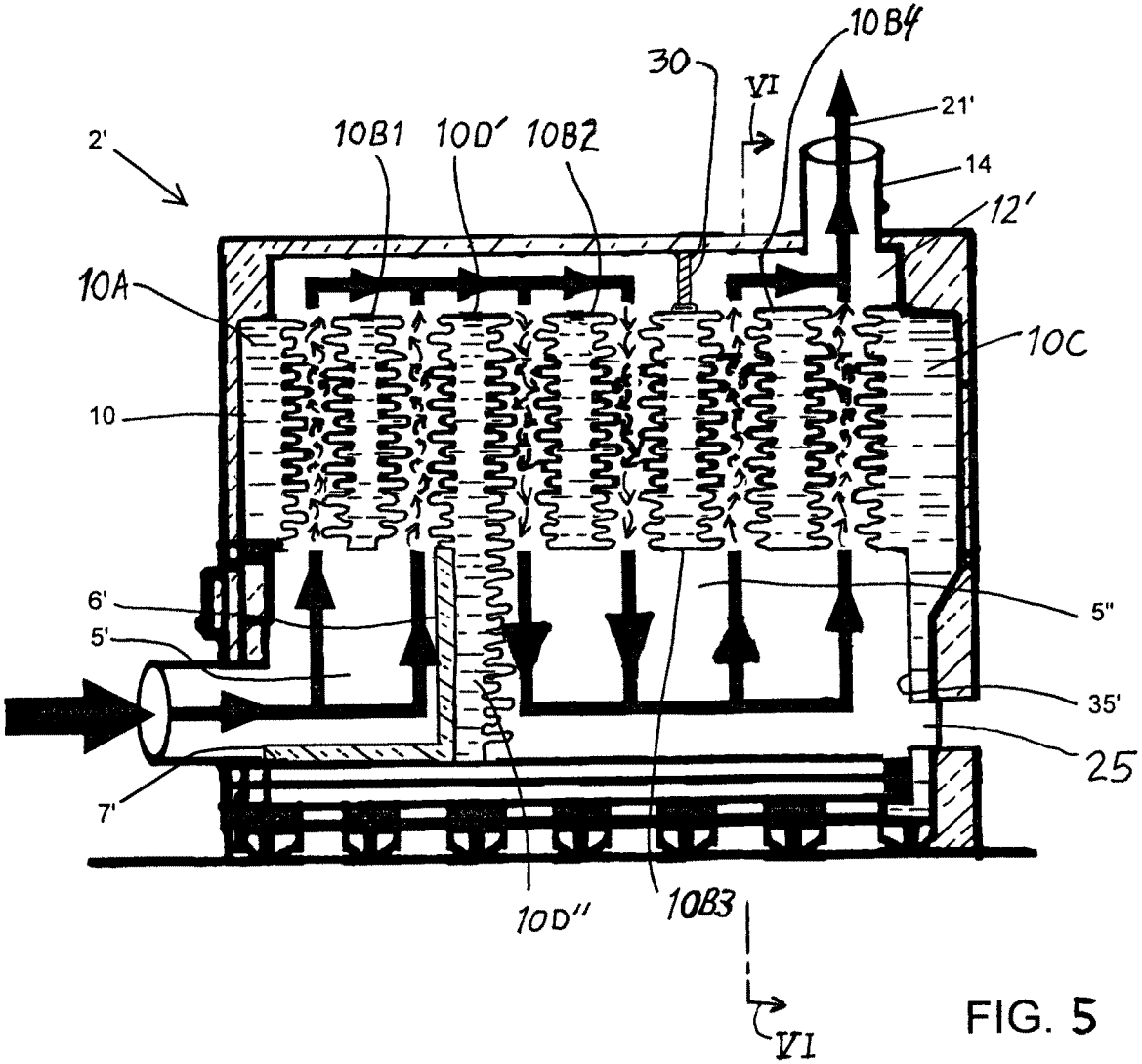
FIG. 5 is a schematic sectional side view similar to that of FIG. 2, but showing a seven-section cast iron boiler that has been retrofitted with one or two replacement sections according to the invention, whereby it has been upgraded and converted into a multi-pass boiler with a multi-pass flue gas flow through the heat exchanger.

While the inventive modifications have been described above in connection with a four-section cast iron sectional boiler as shown in FIGS. 1, 2 and 3, the same or similar inventive replacement components, features, method steps and concepts can be employed for improving the efficiency of other types, configurations and constructions of boilers as well. For example, this can be achieved with regard to a seven-section cast iron sectional boiler as will be discussed next with regard to another embodiment as shown in FIG. 5. Furthermore, this is also true for various configurations of sectional boilers made of materials other than cast iron, for example cast aluminum sections, stamped steel sections, etc. In each situation, it is simply necessary to fabricate and install one or more suitable replacement sections (instead of one or more original sections of the boiler) at appropriate locations so as to divert the original single-pass flue gas flow into a multi-pass flow through various flue passages of the heat exchanger.

FIG. 5 is a sectional side view similar to that of FIG. 2, but showing a different, larger, inventively retrofitted boiler 2'. Namely, the boiler 2' in FIG. 4 is a seven-section cast iron boiler, in comparison to the four-section boiler 1' of FIG. 2. The seven-section boiler 2' is generally similar to the four-section boiler 1', except that it has three more intermediate sections of the boiler chassis to construct a longer boiler with a higher heat output capacity. The boiler 2' also started out as a conventional boiler, but according to another embodiment of the invention, it was retrofitted by replacing only one of the original intermediate sections with a target wall section 10D', and by providing an upper draft diverter 30 in the upper flue collector chamber. The upper draft diverter 30 in this case may be a metal plate that is secured in place by refractory caulking, or may be secured (e.g. welded) to the flue collector hood to become a part of the flue collector hood and sealed relative to the intermediate section below it by a gasket or the like. The original flue collector hood can be replaced by a new replacement flue collector hood that includes the upper draft diverter 30 as a component thereof. Alternatively, the upper draft diverter 30 may be one or more pieces of refractory ceramic fiber board secured in place by refractory caulking. Thus, in the present embodiment, it is not necessary to replace a second intermediate section with a replacement section 10E' as discussed above in connection with FIGS. 2 and 3, because the added upper draft diverter 30 serves the purpose of the draft diverter portion 10E". The upper draft diverter 30 may also be provided with an adjustable bypass opening like the opening 26 discussed above. This embodiment, which involves replacing only a single section of the boiler with the replacement section 10D' and providing the upper draft diverter 30, is not limited to the seven-section boiler as shown in FIG. 5, but also pertains to other boilers such as a four-section boiler as shown in FIGS. 1 and 2. This embodiment represents a very simple, low-cost manner of retrofitting a boiler according to the invention. As a further simplification, when the original boiler already has a rear clean-out hole 25 as shown in FIG. 5, there is no need of providing a clean-out hole through the target wall portion 10D".

The illustration of FIG. 5 has been simplified by omitting the burner unit, water return fitting, water supply fitting, etc., but any omitted features are similar to those described above in connection with FIGS. 1 and 2. However, as shown in FIG. 4, the larger seven-section boiler 2' has a total of six flue passages through the heat exchanger 10. This allows the replacement section 10D' and the upper draft diverter 30 to be arranged in positions (i.e. to replace the original third and fifth sections) so as to produce a diverted flue gas multi-pass flow pattern through two adjacent flue passages at a time in parallel to each other, first upwardly through the heat exchanger 10, then back downwardly through the heat exchanger 10, and then again upwardly through the heat exchanger 10 to be discharged as exhaust gas 21' through the flue outlet 14. Namely, the flue gas flows through respective pairs of flue passages in parallel with one another, and in series through three of such pairs of flue passages in succession. It is apparent that even in this larger seven-section boiler, or in any sectional boiler having at least four sections, only one or at most two of the intermediate sections of the original boiler need to be replaced respectively by the replacement section 10D' (with extended target wall 10D") and optionally the replacement section 10E' (with extended upper draft diverter 10E") or the upper draft diverter 30. The original front section, back section and all other intermediate sections 10B1, 10B2, 10B3 and 10B4, as well as the chassis securing bolts or threaded rods, the plumbing connections, electrical connections, etc. are kept and reused in the upgraded boiler 2'.

The arrows in FIG. 5 schematically illustrate the hot flue gas flow pattern. Because the gas flow pattern always includes two flue passages parallel to one another, therefore, the arrangement in the boiler 2' according to FIG. 4 allows about twice as much flue gas flow as the arrangement in the boiler 1' of FIG. 2. Accordingly, the boiler 2' allows roughly twice the oil firing rate and twice the heat output of the boiler 1'. Such an arrangement with two parallel flue passages for each pass through the heat exchanger 10 is also necessary to maintain a sufficiently high oil firing rate and combustion rate to achieve the required heat output of the larger seven-section boiler. In other words, it would generally not be possible to divert the flow of flue gas from the original single pass configuration through all six flue passages, down to six passes through a single flue passage at a time, because the single flue passage would be too small a constriction.

Figure 6:
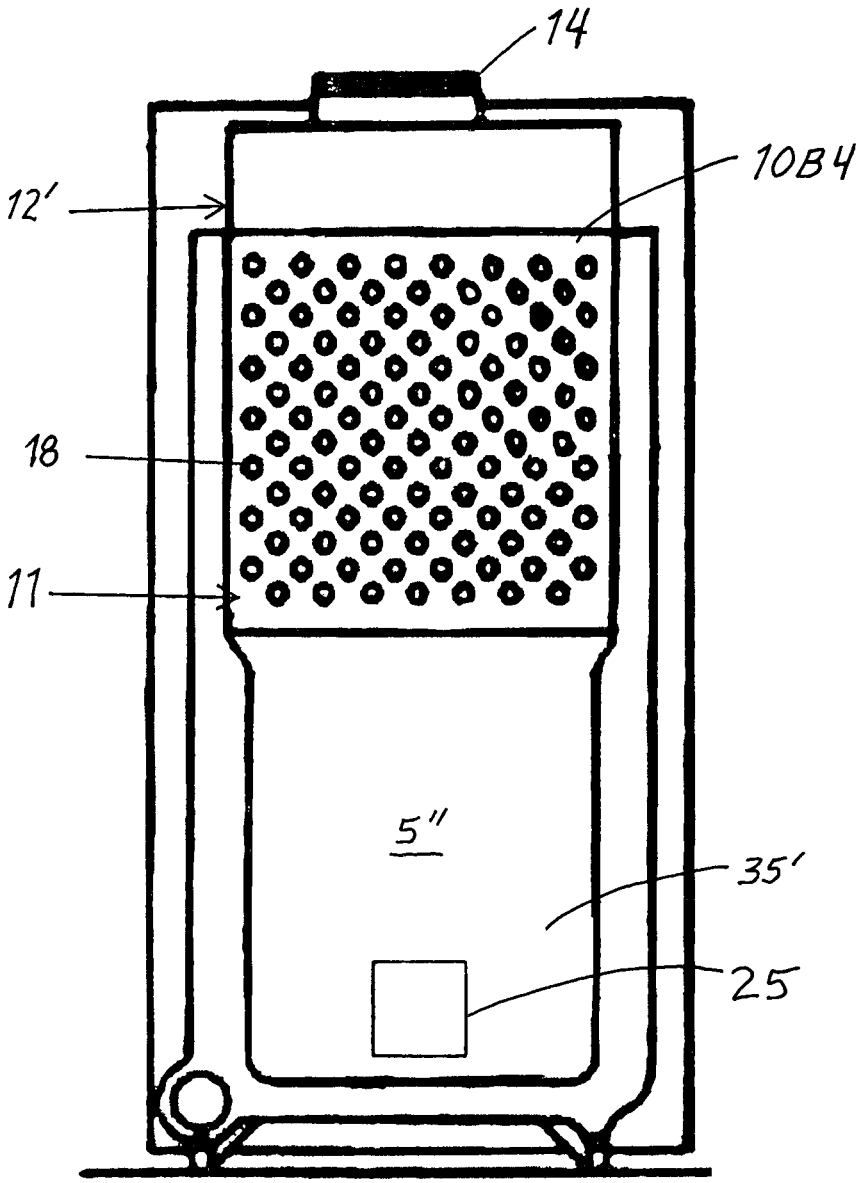
FIG. 6 is a schematic sectional front view of the inventive upgraded and converted boiler according to FIG. 5, taken along the section line VI-VI in FIG. 5.

FIG. 6 schematically shows a sectional view looking toward the right on the section line VI-VI as indicated in FIG. 5. FIG. 6 thus shows a front view of one of the original intermediate sections 10B4. Especially by comparison with FIGS. 3 and 4, it is apparent that the original intermediate section 10B4 (as well as all of the other original sections and the replacement section 10D') lacks the upwardly extending draft diverter portion 10E" of the draft diverter replacement section 10E' as shown in FIG. 3, and lacks the downwardly extending target wall portion 10D" of the target wall replacement section 10D' as shown in FIG. 4. Thus, by comparing FIGS. 3 and 4 with FIG. 6, it is especially apparent how the inventive replacement sections 10D' and 10E' differ from the original sections 10B that they are replacing.

It should further be understood, while not illustrated, that other smaller or larger boilers can also be outfitted with the replacement section(s) and other modifications according to the invention, in a similar manner as in the boilers 1' and 2' discussed above. For example, a ten-section boiler with nine flue passages can be retrofitted with two replacement sections 10D' and 10E' to replace two of the intermediate sections of the original boiler (or only one replacement section 10D' plus an upper draft diverter 30), to achieve a three-pass flue gas flow, respectively through three flue passages at a time, namely the flue gas flowing upwardly through the first three flue passages, followed by flowing downwardly through the next three flue passages, and then finally flowing upwardly through the last three flue passages. It is also not absolutely necessary that each pass through the heat exchanger must use the same number of flue passages. For example, in a six-section boiler with a total of five flue passages, the replacement section 10D' can be arranged to use the first two flue passages for upflow through the heat exchanger, and the replacement section 10E' can be arranged to use a single flue passage providing downflow through the heat exchanger, followed by an upflow through the last two flue passages. In such an arrangement (or any other arrangement disclosed herein), a bypass hole or gap may be provided respectively in the target wall portion 10D" and in the upper draft diverter portion 10E" or upper draft diverter 30 (as discussed above) to allow a bypass flow though these components, so that some of the flue gas does not follow the multi-pass circuit but rather makes only a single pass through the heat exchanger. For example, about two thirds (⅔) of the combustion gas is diverted upwardly through the first two flue passages while about one third (⅓) of the combustion gas bypasses through the bypass hole in the target wall portion 10D". Then, one third (⅓) of the combustion gas is diverted downwardly through the third flue passage while one third bypasses through the bypass hole in the upper draft diverter portion 10E". Finally, the downwardly diverted ⅓ and the ⅓ of the combustion gas diverted through the target wall portion 10D" combine and pass upwardly through the last two flue passages, and are then joined by the ⅓ of combustion gas that was bypassed through the upper draft diverter portion 10E". Depending on the required firing rate, the required over-fire draft, the number of flue passages, etc., various different positions and arrangements of the replacement sections are possible. For example, it is also possible to provide additional replacement sections extending downwardly into the heat exchange chamber 5' and/or upwardly into the flue collector chamber 12, in order to create a five-pass flow pattern through the heat exchanger 10 of a boiler that has a least six sections, rather than the illustrated three-pass flow pattern. However, generally the three-pass flow pattern is preferred, because a higher number of passes through the heat exchanger may result in too great a constriction on the flue gas flow in most applications.

While the invention has been described in connection with retrofitting an existing old or "used" boiler with one or two new replacement sections, of course a new boiler having all new sections can be constructed in the same manner using new sections 10D' and 10E', or a new section 10D' plus an upper draft diverter 30, together with new intermediate sections 10B. The special sections 10D' and 10E' according to the invention can be manufactured just as easily as conventional sections 10A, 10B and 10C, by any existing boiler manufacturer or other metal casting foundry. A boiler manufacturer can thus sell the special new replacement sections 10D' and 10E' as retrofit upgrades to old existing single-pass sectional boilers, and/or can sell new boilers (or boiler part kits) already including the special new sections 10D' and 10E'. Because the other sections 10A, 10B and 10C can remain according to the old designs for these sections, the need for retooling the foundry (e.g. with new casting molds) to produce the new boilers is minimized, existing inventory of previous sections 10A, 10B and 10C can still be sold, and boilers can be sold with either the old single-pass design or the new multi-pass design out of existing inventory with new sections as needed. Assembling and installing such a new multi-pass boiler, or retrofitting an existing single-pass boiler with the multi-pass upgrade, and the ongoing servicing and maintenance of the upgraded boiler, requires essentially only the same skills and knowledge of a typical boiler technician familiar with single-pass sectional boilers. A boiler technician of ordinary skill in the art can also readily identify and distinguish a fully new boiler from a boiler that includes some used sections and some new replacement sections. Namely, once a section has been used in an operating boiler, the section exhibits visibly apparent characteristics resulting from exposure to high temperature combustion, such as soot, sulfur or metal oxide scale deposited on an exterior surface, color changes on an exterior surface induced by exposure to high temperature combustion gas, and/or water scale deposited on an interior surface of the hollow interior space of the section.

Throughout this application text, directional terms such as upper, lower, upwardly, downwardly, front, back, horizontal, etc. relate to the preferred orientation of the boiler as shown in the drawing figures. However, it should be understood that the inventive teachings can also be applied to other boiler configurations or orientations, for example a boiler that is "upside down" or rotated by 90° relative to the present drawing figures, or a boiler that is fired from the side of the combustion chamber rather than the front as shown in present FIGS. 1 and 2.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. A sectional boiler for producing hot water, comprising:

a front section that includes a heat exchanger portion having a hollow interior space configured and adapted to be filled with water;

a back section that includes a heat exchanger portion having a hollow interior space configured and adapted to be filled with water;

a second section that is arranged between said front section and said back section, and that includes an upper heat exchanger portion and a lower target wall portion which both have a hollow interior space configured and adapted to be filled with water;

a third section that is arranged between said second section and said back section, and that includes a heat exchanger portion having a hollow interior space configured and adapted to be filled with water;

a flue collector hood arranged above said respective heat exchanger portions of said front section, said second section, said third section and said back section to define and bound a flue collector chamber between said flue collector hood and said respective heat exchanger portions; and an upper draft diverter arranged in said flue collector chamber above said heat exchanger portion of said third section;

wherein:

said upper draft diverter divides said flue collector chamber into a flue gas diverting chamber on a front side of said draft diverter and a breech chamber on a back side of said draft diverter;

said target wall portion of said second section forms a divider between a combustion chamber on a front side of said target wall portion and a heat exchange chamber on a back side of said target wall portion;

at least one first flue passage communicates from said combustion chamber to said flue gas diverting chamber, between said heat exchanger portion of said front section and said heat exchanger portion of said second section;

at least one second flue passage communicates from said flue gas diverting chamber to said heat exchange chamber, between said heat exchanger portion of said second section and said heat exchanger portion of said third section;

at least one third flue passage communicates from said heat exchange chamber to said breech chamber, between said heat exchanger portion of said third section and said heat exchanger portion of said back section;

said boiler has a flue outlet communicating out of said boiler from said breech chamber;

said boiler is configured to allow a fuel to be introduced and burned in said combustion chamber, to produce combustion gas; and said target wall portion and said upper draft diverter are configured and arranged to cause at least a majority of the combustion gas to flow from said combustion chamber through said at least one first flue passage to said flue gas diverting chamber, and from said flue gas diverting chamber through said at least one second flue passage to said heat exchange chamber, and from said heat exchange chamber through said at least one third flue passage to said breech chamber.

2. The sectional boiler according to claim 1, wherein said upper draft diverter is an independent component distinct from said third section and said flue collector hood, and said upper draft diverter is secured in place between said third section and said flue collector hood.

3. The sectional boiler according to claim 1, wherein said upper draft diverter is permanently connected to said flue collector hood and temporarily sealed to and removable from said third section.

4. The sectional boiler according to claim 1, wherein said upper draft diverter is integrally joined as one piece with, and integrally extends upwardly from, said heat exchanger portion of said third section.

5. The sectional boiler according to claim 4, wherein said upper draft diverter has a hollow interior space configured and adapted to be filled with water, in communication with said hollow interior space of said heat exchanger portion of said third section.

6. The sectional boiler according to claim 5, wherein a surface of said upper draft diverter facing said flue gas diverting chamber has pins, fins or vanes that project from said surface into said flue gas diverting chamber.

7. The sectional boiler according to claim 4, wherein said front section and said back section are previously used and exhibit at least one characteristic of having been previously used, wherein said at least one characteristic is selected from the group of characteristics consisting of soot deposited on an exterior surface thereof, sulfur deposits on said exterior surface thereof, metal oxide scale formed on said exterior surface thereof, temperature-induced color changes on said exterior surface thereof, and/or water scale deposited on an interior surface of said hollow interior space of said heat exchanger portion thereof, and wherein said second section and said third section are new and do not exhibit any of said characteristics of having been previously used.

8. The sectional boiler according to claim 1, wherein said front section is previously used and exhibits at least one characteristic of having been previously used, wherein said at least one characteristic is selected from the group of characteristics consisting of soot deposited on an exterior surface thereof, sulfur deposits on said exterior surface thereof, metal oxide scale formed on said exterior surface thereof, temperature-induced color changes on said exterior surface thereof, and/or water scale deposited on an interior surface of said hollow interior space of said heat exchanger portion thereof, wherein said second section is new and does not exhibit any of said characteristics of having been previously used.

9. The sectional boiler according to claim 8, wherein said third section and said back section are each previously used and each exhibit at least one of said characteristics of having been previously used.

10. The sectional boiler according to claim 8, wherein said third section is new and does not exhibit any of said characteristics of having been previously used, and wherein said back section is previously used and exhibits at least one of said characteristics of having been previously used.

11. The sectional boiler according to claim 1, wherein said front section, said second section, said third section and said back section are all new and do not exhibit any of the following characteristics of having been previously used: soot deposited on an exterior surface thereof, sulfur deposits on said exterior surface thereof, metal oxide scale formed on said exterior surface thereof, temperature-induced color changes on said exterior surface thereof, and/or water scale deposited on an interior surface of said hollow interior space of said heat exchanger portion thereof.

12. The sectional boiler according to claim 1, wherein said upper draft diverter has a bypass opening therethrough, with an adjustable closure to enable adjustment of an open cross-sectional area of a bypass passage communicating from said flue gas diverting chamber through said bypass opening and past said adjustable closure into said breech chamber.

13. The sectional boiler according to claim 1, wherein said target wall portion has a bypass opening therethrough, with an adjustable closure to enable adjustment of an open cross-sectional area of a bypass passage communicating from said combustion chamber through said bypass opening and past said adjustable closure into said heat exchange chamber.

14. The sectional boiler according to claim 1, wherein a surface of said target wall portion facing said heat exchange chamber has pins, fins or vanes that project from said surface into said heat exchange chamber.

15. The sectional boiler according to claim 1, further comprising refractory ceramic fiber insulation on said front side of said target wall and on a bottom floor of said boiler bounding a bottom of said combustion chamber, and wherein there is no refractory ceramic fiber insulation arranged anywhere in said heat exchange chamber.

16. The sectional boiler according to claim 1, wherein said combustion chamber has a first length measured horizontally from said front section to said front side of said target wall portion, wherein said heat exchange chamber has a second length measured horizontally from said back side of said target wall portion to said back section, and wherein said second length is from 1.5 to 3 times said first length.

17. The sectional boiler according to claim 1, further comprising:

a first intermediate section arranged between said front section and said second section;

a second intermediate section arranged between said second section and said third section; and a third intermediate section arranged between said third section and said back section;

wherein:

said first intermediate section includes a heat exchanger portion that extends from said combustion chamber to said flue gas diverting chamber;

said second intermediate section includes a heat exchanger portion that extends from said heat exchange chamber to said flue gas diverting chamber;

said third intermediate section includes a heat exchanger portion that extends from said heat exchange chamber to said breech chamber;

said at least one first flue passage includes two first flue passages respectively on opposite sides of said first intermediate section;

said at least one second flue passage includes two second flue passages respectively on opposite sides of said second intermediate section; and said at least one third flue passage includes two third flue passages respectively on opposite sides of said third intermediate section.

18. The sectional boiler according to claim 1, wherein said back section has a clean-out opening that has an openable cover and that communicates from outside of said boiler into said heat exchange chamber.

19. The sectional boiler according to claim 1, wherein said target wall portion of said second section has a clean-out opening that has an openable cover and that communicates from said combustion chamber into said heat exchange chamber.

20. The sectional boiler according to claim 1, being a wet base boiler, wherein the front section, the second section, the third section and the back section each include two hollow side portions and a hollow base portion configured and adapted to be filled with water, wherein the combustion chamber is defined by an opening or recessed cavity in the front section and/or the second section, between the heat exchanger portion and the base portion thereof, and between the two hollow side portions thereof, and wherein the heat exchange chamber is defined by an opening in the third section and optionally a recessed cavity in the back section, between the heat exchanger portion and the base portion thereof, and between the two hollow side portions thereof.

* * * * *